United States Patent [19]

You

[11] Patent Number: 4,477,998

[45] Date of Patent: Oct. 23, 1984

[54] FANTASTIC WALL-CLIMBING TOY

[76] Inventor: Yun-Long You, No. 16 Tien Shin Rd., Fong Yuan City 420 Taichung, Taiwan

[21] Appl. No.: 499,454

[22] Filed: May 31, 1983

[51] Int. Cl.[3] ..... A63H 11/04

[52] U.S. Cl. ..... 446/177; 446/199; 446/433

[58] Field of Search ..... 46/251, 124, 123, 206, 46/103, 132, 266

[56] References Cited

U.S. PATENT DOCUMENTS

| | | | |
|---|---|---|---|
| 2,618,889 | 11/1952 | Wigal | 46/132 X |
| 2,728,168 | 12/1955 | Gier | 46/103 |
| 2,779,127 | 1/1957 | Holman | 46/132 X |
| 3,061,972 | 11/1962 | Wigal | 46/206 |
| 3,638,354 | 2/1972 | Morrison | 46/132 X |
| 3,810,515 | 5/1974 | Ingro | 46/251 X |
| 4,258,500 | 3/1981 | Anderson | 46/264 |
| 4,333,259 | 6/1982 | Pin-Huang | 46/266 X |

*Primary Examiner*—F. Barry Shay

*Attorney, Agent, or Firm*—Burns, Doane, Swecker & Mathis

[57] ABSTRACT

A wall climbing toy has a drive mechanism comprising a driven endless belt and a plurality of suction disks mounted on the belt. A plurality of wires interconnect the belt with the disks to (1) pull the latter from the surface, and (2) bend the disks toward a surface-confronting condition as the disks approach the surface.

1 Claim, 4 Drawing Figures

FANTASTIC WALL-CLIMBING TOY

BACKGROUND OF THE INVENTION

The industry of toy has created many different types of toys, such as walkable toys, but has not created a kind of toy which climbs on the wall.

The present inventors have, however, now designed such a toy which is capable of walking on walls.

SUMMARY OF THE INVENTION

The present invention includes a conveyable belt on which there are several sucking disks; which produce an effect of climbing forward and/or upward on the wall. Such a belt structure is able to be mounted in the bodies of various kinds of toys such as animals, dolls, etc.

The invention exhibits a simplicity of structure which promotes the adherence and separation of the sucking disks relative to the wall to achieve an ideal movement of climbing forward or upward on the wall.

DESCRIPTION OF THE PREFERRED EMBODIMENT

Figure 1:
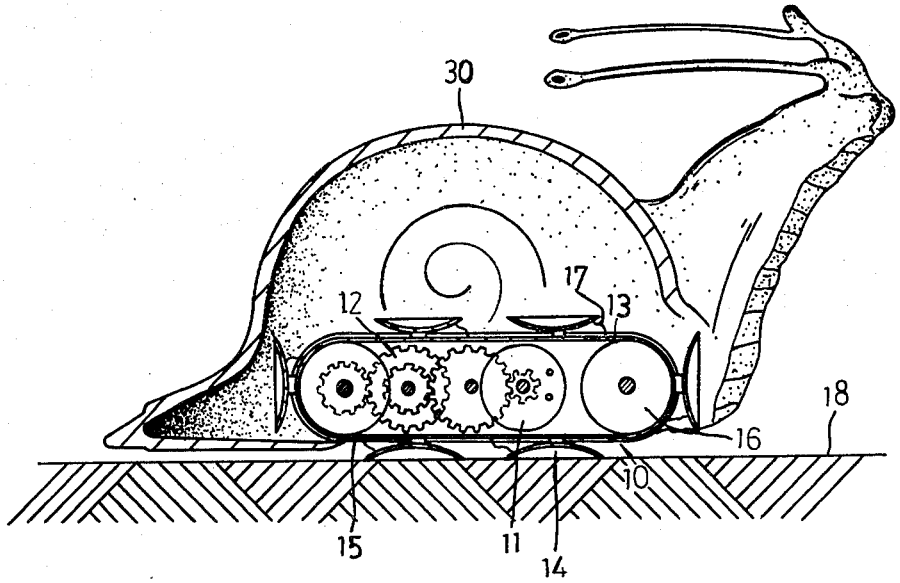
FIG. 1 is a vertical sectional view through a toy according to the present invention.

FIG. 1 depicts a wall-climbing snail (30). A heart portion (10) is installed inside the body of the snail (30). The said heart portion (10) can also be installed in the bodies of various birds, animals, and dolls, etc. This portion is functioning that, a motor (11) rotates a group of gears to drive the surrounded belt (13). On the belt (13) there are several sucking disks (14) which are thus and/or stand steadily there on the wall but without falling down. However, although these sucking disks (14) are very important adhering components, there is trouble that, once the whole body of the snail or the other toy is adhered to the wall, it is often hard to split it away from the wall without a great deal of effort. This problem is solved by the present invention.

Figure 2:
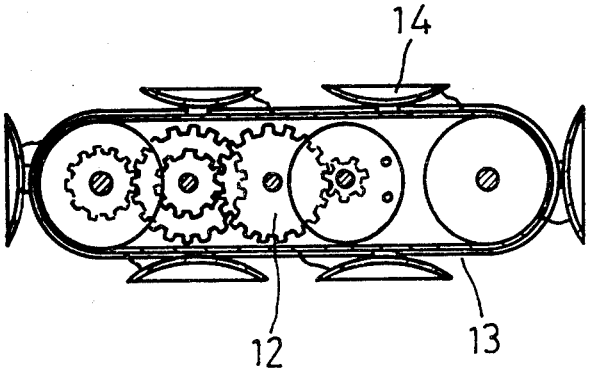
FIG. 2 is a side elevational view of a driven conveyor belt and disks according to the invention.
Figure 3:
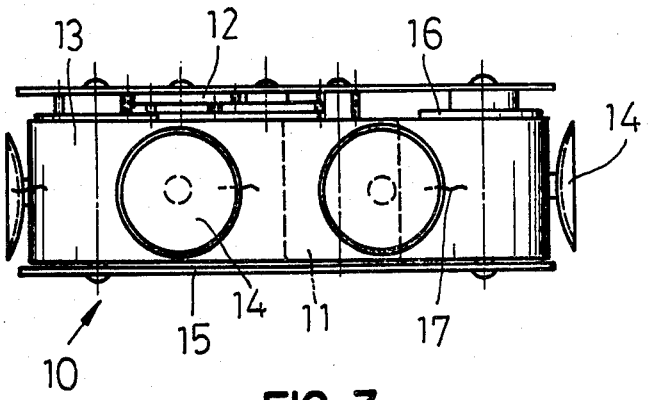
FIG. 3 is a top view of the conveyor belt and disks.

As can be seen in FIGS. 2 and 3, a plate (15) forms a wall of the heart portion (10). A motor (11) and the group of transmission gears (12) are installed on an inner side of the plate (15). The gears reduce the motor's running speed to slow down the rotating of rollers (16) which are built in cylindrical shape. A belt (13) is surrounding the outer edges of the rollers (16) as well as the outer side of the plate (15). The belt carries several sucking disks (14) on its upper flight (away from the support surface) and lower flight (adjacent the support surface). At the reverse side of circumferential edges of these sucking disks, there are mounted pulling wires (17); which eliminate the difficulty of split away these sucking disks from the wall. The other end of each wire is fixed to the belt (13).

During climbing on the wall, the motor is running, and the gears drive the surrounded rollers (16) while the belt (13) is also in rotating. When a sucking disk (14) is running downward toward contact with the wall surface, the pulling wire moves downward first to make the downward edge of the sucking disk (14) bend slightly toward the plane of the wall surface and further to keep the sucking disk (14) and the belt (13) both downward but not affect the adhering function by 'concaved-folding'. Hence the sucking disk can be moved downward smoothly and adhere firmly on the wall. In the meantime, the belt (13) is continuing in rotating to make the sucking disk (14) firmly engage the wall surface (18). When the adhered sucking disk (14) reaches the end of its working stroke, the disk is still adhered to the wall surface (18), but the pulling wire (17) starts moving upward and pulls slightly the rear end of the sucking disk and thus easily releases the sucking disk for moving upward and forward together with the belt (13) for repeating the cycle all over again.

Figure 4:
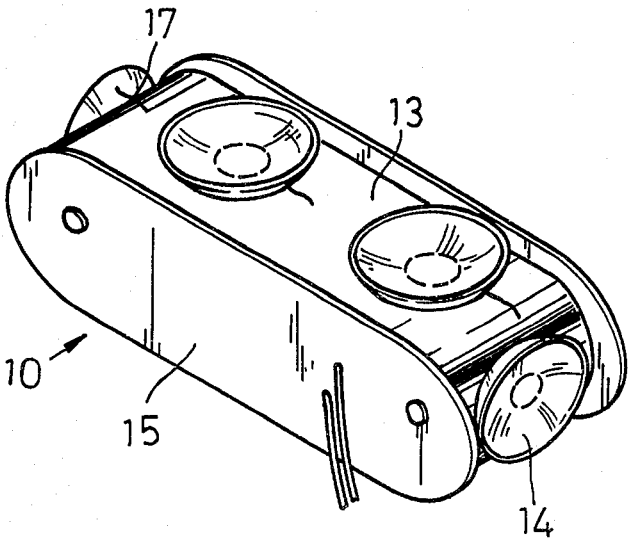
FIG. 4 is a perspective view of the conveyor belt and disks.

In FIG. 4 the sucking disk (14) is shown as fixed with the belt (13). A pulling wire (17) is linking between the peripheral edge of the sucking disk (14) and the belt (13) so that when the belt (13) is moving by transmission effort from the roller (16), in rotating, the pulling wire (17) effects proper control for the adhering and/or splitting of the sucking disk (14) and thus during climbing forward on the wall. The said heart portion (10) can be used in various types/models of toys.

What we claim is:

1. A wall climbing toy comprising:

an outer body, having front and rear ends, a drive mechanism disposed within said body, said drive mechanism comprising:

an endless belt having an upper flight and a lower flight, a plurality of suction disks mounted on said belt for contacting a surface, a drive motor, speed reducing gear means drivingly interconnecting said motor and said endless belt for rotating said belt to bring said suction disks into contact with a surface at a front end of said lower flight when said body is driven forwardly, and to pull said suction disks from the surface at a rear end of said lower flight, and a plurality of wires connecting said belt with each of said suction disks, said wires each having a first end fixed to said belt and a second end fixed to an associated disk at an edge thereof which first arrives at said rear end of said lower flight as the latter moves rearwardly, to pull said rear edge upwardly in response to upward travel of said first end of said wire, each said wire bending its associated disc toward an orientation confronting the surface as such disk approaches contact with the surface at said front end of said lower flight to promote adherence with the surface.

* * * * *